US011844964B2

(12) United States Patent
Allen

(10) Patent No.: US 11,844,964 B2
(45) Date of Patent: Dec. 19, 2023

(54) MULTI-USE RESCUE ACCESS BAR

(71) Applicant: Jason Allen, Kelso, WA (US)

(72) Inventor: Jason Allen, Kelso, WA (US)

( * ) Notice: Subject to any disclaimer, the term of this patent is extended or adjusted under 35 U.S.C. 154(b) by 0 days.

(21) Appl. No.: 17/720,742

(22) Filed: Apr. 14, 2022

(65) Prior Publication Data

US 2023/0330446 A1 Oct. 19, 2023

(51) Int. Cl.
*A62B 3/00* (2006.01)
*B25F 1/00* (2006.01)

(52) U.S. Cl.
CPC ..... *A62B 3/005* (2013.01); *B25F 1/006* (2013.01)

(58) Field of Classification Search
CPC . A62B 3/005; A62B 5/00; B25F 1/006; B25F 1/00; B25F 1/02; B25D 1/00; B25D 1/04; B25D 1/14; B25D 3/00; B25D 7/00; A62C 8/00; B66F 15/00; B67B 7/44; B25C 11/00; E04G 23/08
USPC ..... 7/166
See application file for complete search history.

(56) References Cited

U.S. PATENT DOCUMENTS

D507,167 S * 7/2005 Richardson ..... A62B 3/005 D8/81
7,367,545 B1 * 5/2008 Chen ..... B66F 15/00 7/166
D595,555 S * 7/2009 Vanderbeek ..... A62C 8/00 D8/89
D752,940 S * 4/2016 Deng ..... D8/81
2002/0138915 A1 * 10/2002 Corsini ..... A62C 8/00 7/143
2007/0226913 A1 * 10/2007 Woolley ..... E04G 23/082 81/46
2018/0354763 A1 * 12/2018 Corette, Jr. ..... B66F 15/00
2021/0347028 A1 * 11/2021 Zanoni ..... A62B 3/005

* cited by examiner

*Primary Examiner* — Brian D Keller
*Assistant Examiner* — Tim Brady
(74) *Attorney, Agent, or Firm* — Apex Juris, pllc; R. Lynette Wylie

(57) ABSTRACT

A multi-use rescue access tool for forcible entry into buildings and other functions, including a rescue bar with opposed head and sickle blade ends. The head end includes paired jaws on one side and a blunt hook with a strike contact face and an open space for insertion of the blunt hook also including a periphery configured for wrench to open and close hydrant valves. A chisel end on an upper jaw may extend beyond a lower jaw. Opposed ends of the rescue bar are configured for paired interlocks with a halligan bar having a fork lever end and adze pick end whereby a pair of aligned prongs of the fork lever end are abutted against corresponding opposed side walls stepping up to aligned raised surfaces of the sickle blade end in a clasped interlock, coupling aligned prongs with opposed recessed channels of a head end in an extended interlock or coupling the adze pick end between paired jaws of the head end to provide a step on the top surface of the head end of the rescue bar in a stepped interlock. Opposed channels of the head end are configured for further coupling the fork lever end within opposed aligned channels of head end to couple the rescue and halligan bars in a parallel juxtaposition.

20 Claims, 14 Drawing Sheets

MULTI-USE RESCUE ACCESS BAR

FIELD OF THE INVENTION

The present invention pertains to rescue tools for access to buildings, particularly for forcible access, through secured doors or other entry points by fire fighters and other first responders to conduct emergency operations.

BACKGROUND OF THE INVENTION

Firefighters among other first responders, are responsible for rapid and effective responses to many diverse emergency situations often involving rescues of entrapped persons in precarious conditions and even life-threatening situations due to multifarious causes including for example, medical ailments, accidental injuries, or being subject to an existing or impending hazard, such as a fire or radioactive or chemical intrusion. Emergency situations very often require use of specialized tools which can cause damage. In many emergency situations including fires, tools to open locked doors are essential for rescue operations including extrication and evacuation of trapped persons and animals and extinguishing fires or shutting off, capping or, abating other toxic elements, such as for example, natural gas or biochemical hazards. Rapid access is of particular import when responding to fire alarms when firefighters must survey and search many rooms of a building for fire, smoke trapped individuals, and for activated smoke or hear detectors or activated fire alarm pull stations.

The nature and extent of emergency scenarios, including injuries and hazards, encountered by first responders, particularly fire rescue workers, is typically unpredictable and rapidly evolving. In the face of mounting numbers of emergency calls and rescue operations and resulting injury and devastation due to various causes including natural disasters such as fires, tornadoes, blizzards, hurricanes and earthquakes, violence, accidents among other hazardous conditions encountered by first responders, the need for swift and sure rescue response is widespread.

Expeditious extrication and abatement of a hazardous condition is imperative to many rescues. Due to the multifarious types of emergencies encountered by a first responder and the high risk, and rapid, unpredictable evolution of an injured patient or a hazard such as a fire or poisonous gas, rapid and ready access to a range of rescue tools is indispensable to addressing the hazard and extracting a victim. For example, in vehicular accident emergencies, rescue and treatment of an injured victim entails extrication from a vehicle with doors damaged, nonfunctional door handles. Conventional tools and techniques include breaking vehicle windows and cutting seatbelts, expedited by appropriate tools. Similarly, expediting extrication of entrapped victims of fire, flood, violent assaults, or other dangers entails employing tools for mitigating the hazard and entry to a space often secured by a locked door. It can thus be readily seen that providing a fire fighter or other first responder with a rescue tool enabling quick and smooth access in order to rescue trapped victims or otherwise abate an emergency situation is key to providing effective responses to the multifarious types of emergencies encountered by first responders.

Firefighters carry numerous different rescue tools to be suitably prepared for the many and diverse potential tasks involved in rescue operations. Such tools were not only numerous but some bulky, awkwardly configured. Storing, carrying, retrieving and switching between the tools is burdensome and often takes valuable time needed for a swift and smooth rescue operation. As a result, unwieldy access or unavailability of requisite access or mitigation may delay response times and potentially cripple rescue and remediation of emergencies that could involve life-threatening emergencies.

U.S. Pat. No. 10,912,957 drawn toward a multifunctional rescue tool provides multiple utilities for rescue operations including tools for opening locked or blocked doors, shoring and clearing passageways, manipulating shut off valves for natural gas, oxygen, fire hydrants and hoses, seat belt cutting and/or breaking glass, among other functions, for thereby enhancing first responder access and mitigation of hazards. The patented tool includes a right-angled blade to enable disengagement of a spring lock that a straight blade or rigid card inserted in the gap between the door and doorjamb cannot reach, particularly when a door lock shield is affixed on the lock portion of a secured door.

Due to unlawful use of such access tools for breaking and entering, building owners have more recently expanded or enlarged door shields that may encompass the entire length of a door. Because these structures extend beyond the lengths of conventional rescue tools, they can impede or delay fire fighters and other first responders needing rapid access to a locked building in order to administer emergency rescue measures.

Although the latter multifunctional rescue tool and other tools address some of the needs for access and rescue, the faces including wedges, pry bars, and claws, of conventional tools provide insufficient leverage and strike or prying mechanisms for expeditious entry through the increasingly density, bulk and layered lock systems of modern doors and passage barriers. As a result, entry through locked doors and blocked passageways and rescue operations may be delayed, leaving individuals and rescue workers trapped in sometimes in life threatening situations. With the steep rise in incidence and spread of fires as well as entrapment of hostages associated with violence, limitations and drawbacks in the leverage and functionalities of prior art pry bars are an increasing detriment blocking rescue of trapped victims and egress of rescue workers beset by smoke, fumes, fire, violence, or other hazards.

Thus, there persists a need for rescue access tools commensurate to the task of breaching secured or block entryways of fortified structures including door and lock shields, concrete composition security features of modern doors as well as other blocks to access points of modern buildings to facilitate first responders access to encroached buildings during rescue operations, particularly tools capable of opening securely locked doors, windows and mechanisms blocking access by first responders to spaces, water and fire retardant pipes and reservoir and similar secured entryways and agents.

SUMMARY OF THE INVENTION

Such and other drawbacks and shortcomings of prior art rescue tools heretofore unsolved are addressed by the present invention's multi-use rescue access bar and tool for forcible entry into buildings including opposed multi-faceted elements on opposing ends of a long handled pair of rescue tools including a rescue bar with opposed jaws and sickle blade ends, and a halligan bar having opposed fork lever and adze pick ends. The fork lever end for prying open windows and doors may be tapered, bent or flat.

In one embodiment, the rescue bar comprises a handle with a head end at a first end of the handle, the head end disposed along a common longitudinal plane with a handle. In one embodiment, the head end includes a paired jaws and a blunt hook located on the head end. By avoiding a sharp contact point, the blunt hook lessens the incidents of getting caught or stuck in the struck or pried material and thereby eases removal therefrom. An additional potential advantage is reducing collateral damage to struck material.

The blunt hook may include a strike contact face that can be used as striking tool, for example, to strike a halligan bar, to thereby amplify force for penetrating or prying open a door or window, wall of other building structure or material for access, demolition, extrication, evacuation or similar operations. The blunt hook may be utilized to engage a gap or penetrate and exterior surface of a structure edifice or wedge against a plank or break apart or otherwise demolish construction materials such as, for example, concrete, wood, metals such as used in car doors and high security exterior doors and gates, or other materials by striking blows upon the material. The strike contact face may also struck by a hammer or other striking tool in some applications.

In various embodiments, the strike contact face includes a plane or surface oriented in parallel with the main longitudinal axis of the handle and perpendicular to the longitudinal central plane of the head end. The strike contact face may include an outer plane that is angled slightly inwardly from a linear plane toward a blunt hook element such that the outer plane of a lower part of the strike contact face is slightly offset from a coextensive upper plane. This slight offsetting of the outer plane reduces the contact surface area and associated friction with an abutting surface to thereby ease sliding and reduce risk of scratching or otherwise damaging an abutting surface. To further facilitate smooth sliding, corners of the strike contact face are rounded in some embodiments to avoid catching on surface protuberances or scratching.

In one embodiment, the head end also includes paired jaws on the opposite side of the head end from the strike contact face. In some embodiments, the paired jaws include one or more teeth on their interior grasping surfaces of the lower and/or upper jaw. Such teeth recesses may be configured or layered with materials to provide various features such as, for example, improved grip, shock absorption, heat transfer resistance, electrical insulation, differential indication, and/or other features.

The paired jaws are configured for disassembling, demolishing, manipulating building materials, such as, for example sheets of siding, plywood, or other materials. In some embodiments, the paired jaws may provide a fixed wrench or alternatively may include an adjustable jaw for grasping material of a corresponding width.

In various embodiments, the opening formed by the paired jaws is perpendicular to the main axis of the handle. Inner surfaces of the paired jaws facing the gap between the paired jaws may be tapered or include one or more stepped portions on one or both of an upper jaw or a lower jaw forming variously dimensioned gaps to fit boards, hardware or other material having different thicknesses.

In some embodiments, the upper jaw extends along longitudinal plane perpendicular to the longitudinal handle axis beyond the lower jaw to form a chisel end. The chisel end may be used to penetrate building materials such as wood (or other materials) for demolition or for other purposes. In various embodiments, the chisel end thickness is tapered toward the edges and may also widen toward a strike end. The tapered configuration of the chisel end further enables forcibly positioning building materials within the gap between the paired jaws. By widening the transverse longitudinal plane toward the chisel end, the enlarged surface area of the chisel end facilitates grasping a door surface when the chisel end is inserted between a door and jamb.

In some embodiments, the chisel end may be bent or angled toward a tapered edge enabling use without interference from other components of the head end, also clears it from the plane of use of the strike face portion of the head end. A particular utility of the chisel end as well as the sickle blade end is to pry behind and/or penetrating door shields. This functionality is of critical import with the increasingly heavier composition and larger area covered by door shields that now often extend to the full length of a door.

The outer edge of the chisel end may include a notch or slot providing a lock puller for loosening or prying a secured door lock back to disengage a bolt from a corresponding receiving box. Other uses may include removing fasteners such as, for example, nails, brads, staples, or other fasteners. The nail puller notch or slot may be tapered or beveled to facilitate slipping the chisel end behind a latch shield or plate.

On an opposing end from the head end of the rescue tool is a sickle blade end disposed along a longitudinal axis of the handle. In some embodiments, the sickle blade end features an integral base portion with an inner side edge and outer edge that extend outwardly from the longitudinal axis of the handle to form an inner claw with an opposed upper pointed end and an outer claw with a lower pointed end that are disposed around a substantially rounded inner clearance space aligned along a longitudinal plane parallel to the main longitudinal axis of the handle of the rescue bar. The upper pointed end and lower pointed end are preferable configured in opposed inwardly facing curves such that their respective pointed ends are disposed toward the respective opposing inner and outer claw. In some embodiments, the opposed crescent claws are tapered toward their respective inner edges defining the inner clearance space.

The narrow and rounded edge of a sickle blade end enable penetrating, prying and loosening layered or rounded materials of barriers to doors, windows or other materials. For example, the sickle blade may be inserted between floor boards, door shields or between bars over a door or a window in order to facilitate access and provide rescue operations in a blocked and/or locked interior space.

In various embodiments, the sickle blade end may include a through hole that may be disposed in a base portion. Among other potential utilities, a particularly efficacious function availed when the blunt hook and/or paired jaws are secured to a suitable fixed object is providing a receiving through hole for coupling a carabiner or other clasp or loop mechanism attached to a line or rope for rappelling in a descent from a window, rooftop or other elevated position or for attaching and lowering something or someone to safety.

A particular efficacy provided by this rescue bar is the capability of securing the blunt hook end onto or about a fixed structural element such as a wall, bar, or other stable edifice or fixture of a building and anchoring a line into a through hole in the opposing sickle blade end whereby the line can be used to facilitate escape from a hazard. For example, the blunt hook end could be wedged or otherwise secured on a metal rail or wood plank and a firefighter could then deploy the anchored line to rappel out of a window or off a rooftop to escape or rescue trapped individuals and pets from a burning or collapsing building. When exits are blocked or infused by smoke or toxic fumes, rappelling or lowering to safety outside a building may be the only escape or rescue route available.

In some embodiments, recessed portions or cavities are provided in the handles of rescue bar and/or halligan bar. Such cavities reduce the amount of metal or other material consumed and thereby reduce manufacturing costs and too weight to thereby ease carrying and improve targeted manipulation of the tools without compromising their structural integrity. One or more concavities along the handle may also be configured to enhance gripping of the rescue bar. Further features may include a plurality of recesses in the handle for improved grip and incorporation or layering of alternative textures and materials for facilitating frictional skid resistance or resilient support for firmer and/or padding grip. For example, a rubberized or otherwise textured outer layer could be applied to the handle of the rescue bar. In some embodiments, the outer layer may have protruded portions corresponding to handle cavities to thereby provide a smoother outer surface. A phosphorescent or bright colored composition could also be applied to enhance visibility of the rescue bar.

The sickle blade and head ends of the rescue bar are configured for mated engagement, with corresponding elements of a halligan bar in at least four interlocked positions. As detailed below, various embodiments of this rescue access tool enable mated interlocking engagement extends tool length thereby leveraging applied force, i.e., manpower, suitable for a corresponding demolition, stepped, pry and wedge operation. The enhanced force imparted by the extended length of the interlocked rescue bar and halligan bar facilitate expedited and enhanced forcible entry into endangered spaces. The resulting elongation of the rescue access tool increases leverage and associated force or torque in order to expedite forcible entry to access endangered spaces. The added leverage is particularly advantageous when penetrating doors composed of concrete or steel and door shields.

Thus deploying the interlocked rescue tool doubles the power of a rescue worker, thereby enabling one to execute the work of two rescue workers. The resulting expediting of rescue operations enables earlier mitigation and rescue of quickly devolving emergencies and is particularly crucial in the face of recent shortages of fire fighters and other rescue workers.

The opposing ends of the halligan bar are configured for mated engagement with a respective fork lever and adze pick ends. The adze pick end has a cutting edge perpendicular to the handle that is slightly bent toward the head end of the rescue bar and may include a tapered pick that may be oriented perpendicular alignment with the longitudinal axis of the handle and the adze pick end.

The rescue bar of the present invention may be provided in a number of lengths, typically ranging between 18-54 inches. They may be composed of an integrally molded metal material, or include multiple parts jointed or fastened together. The rescue access tool, including the handle, the head, the bent end pry bar, and/or other portions of the rescue access tool, may comprise a single integrally molded metal material. Various embodiments of this rescue bar weigh between about 6 and 12 pounds.

These and other objects, features, and advantages of the invention will be apparent through the detailed description of the preferred embodiments and the drawings attached hereto. It is also to be understood that both the foregoing summary and the following detailed description are exemplary and not restrictive of the scope of the invention.

DETAILED DESCRIPTION OF THE INVENTION

All definitions, as used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used in the specification and in the claims, "or" is synonymous to "and/or" as defined above. For example, when separating articles in a list, "or" or "and/or" shall be interpreted as being inclusive, i.e., the inclusion of at least one, but also including more than one, of a number or list of elements, and, optionally, additional unlisted articles. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

All transitional phrases such as "comprising," "including," "carrying," "having," "containing," "involving," "relating to," "composed of," and the like are to be understood to be open-ended, i.e., to mean including but not limited to.

The invention provides a rescue access bar and tools for forcible entry to a building together with other functions.

Figure 2:
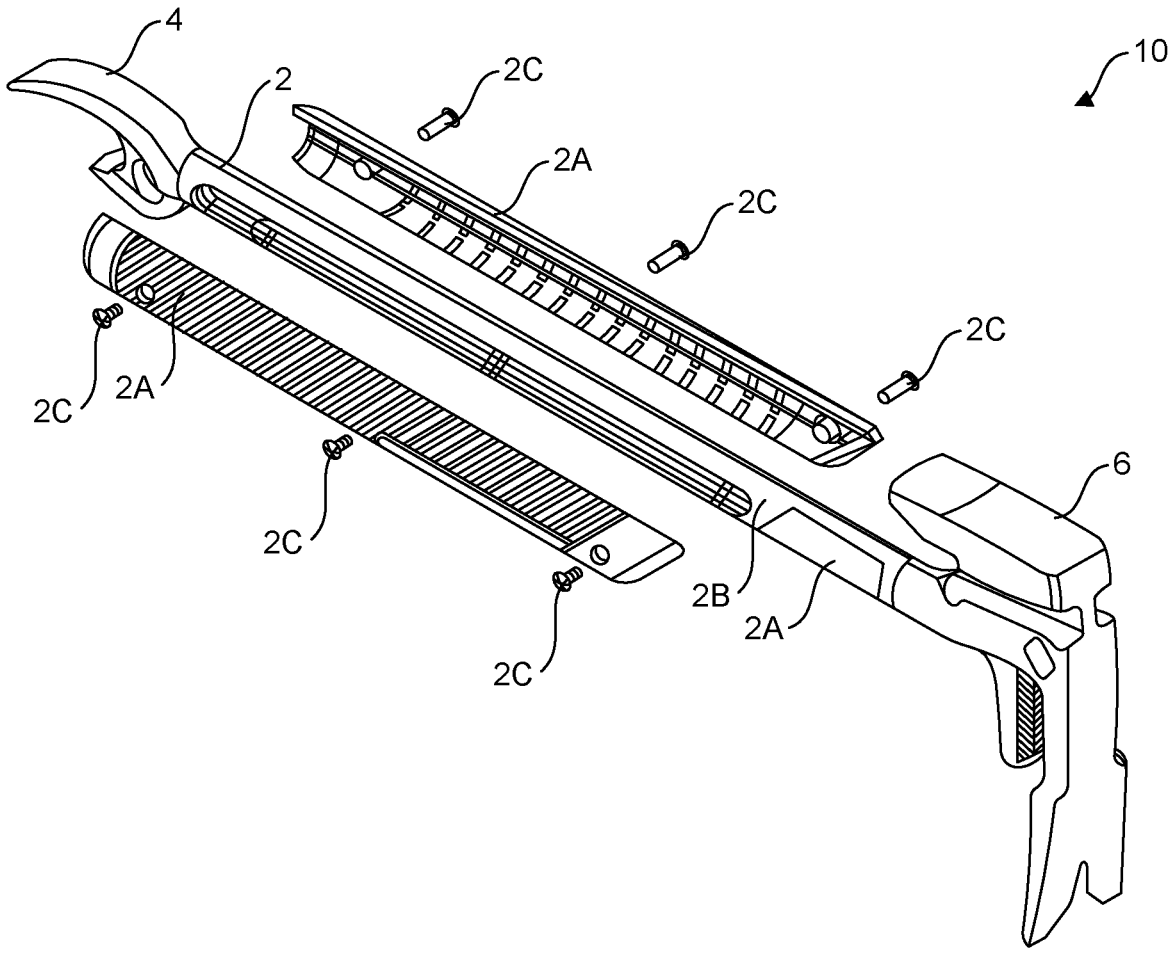
FIG. 2 is an exploded view of the rescue bar of FIG. 1 with a detached grip cover.
Figure 3:
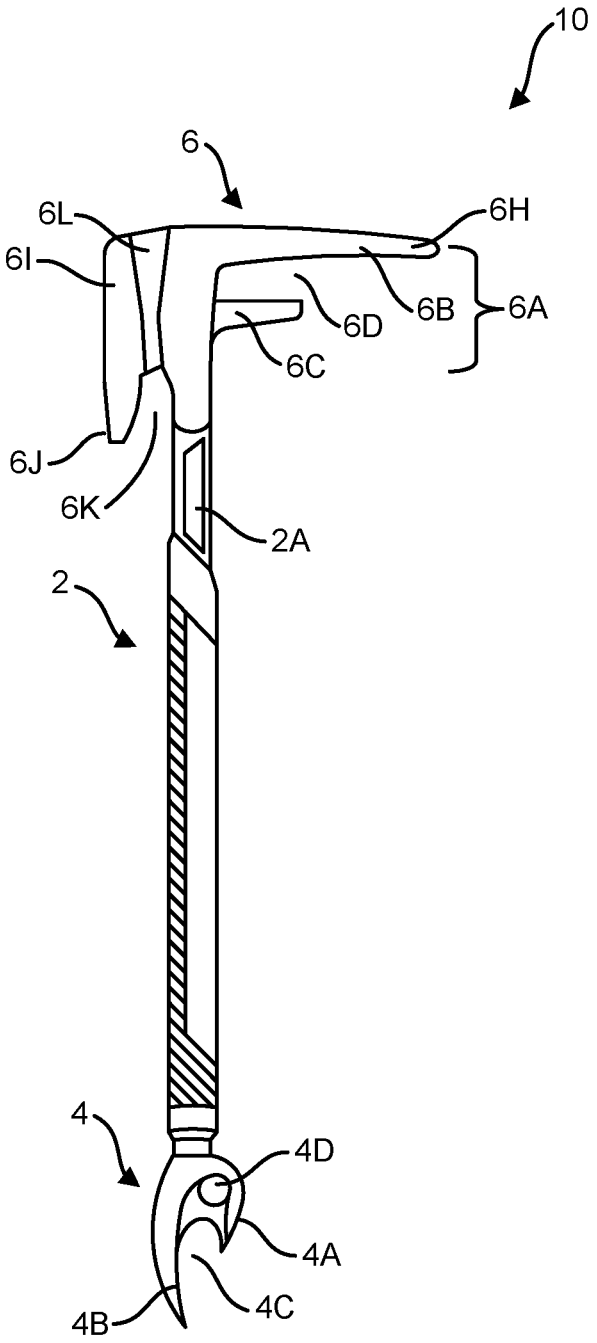
FIG. 3 is a left side view of the rescue bar of FIG. 1.
Figure 4:
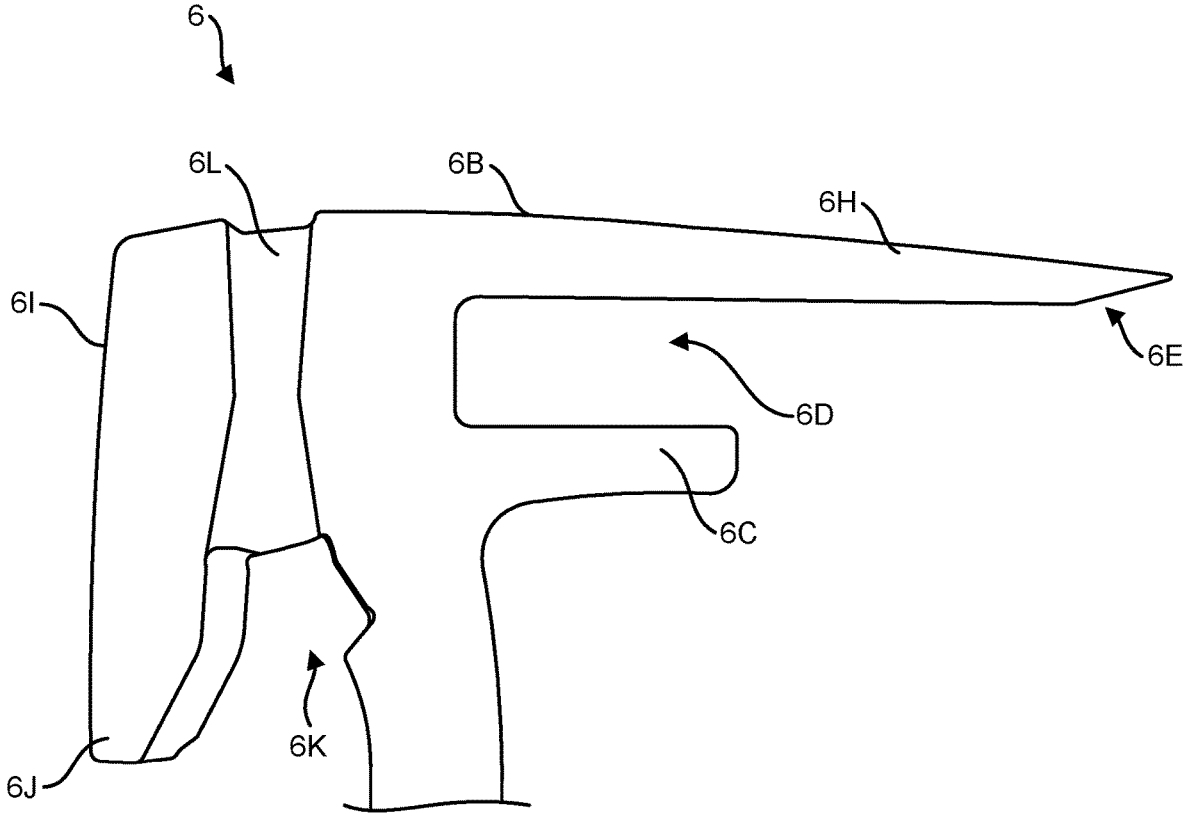
FIG. 4 is a close up view of the head end of the illustrated rescue bar.
Figure 5:
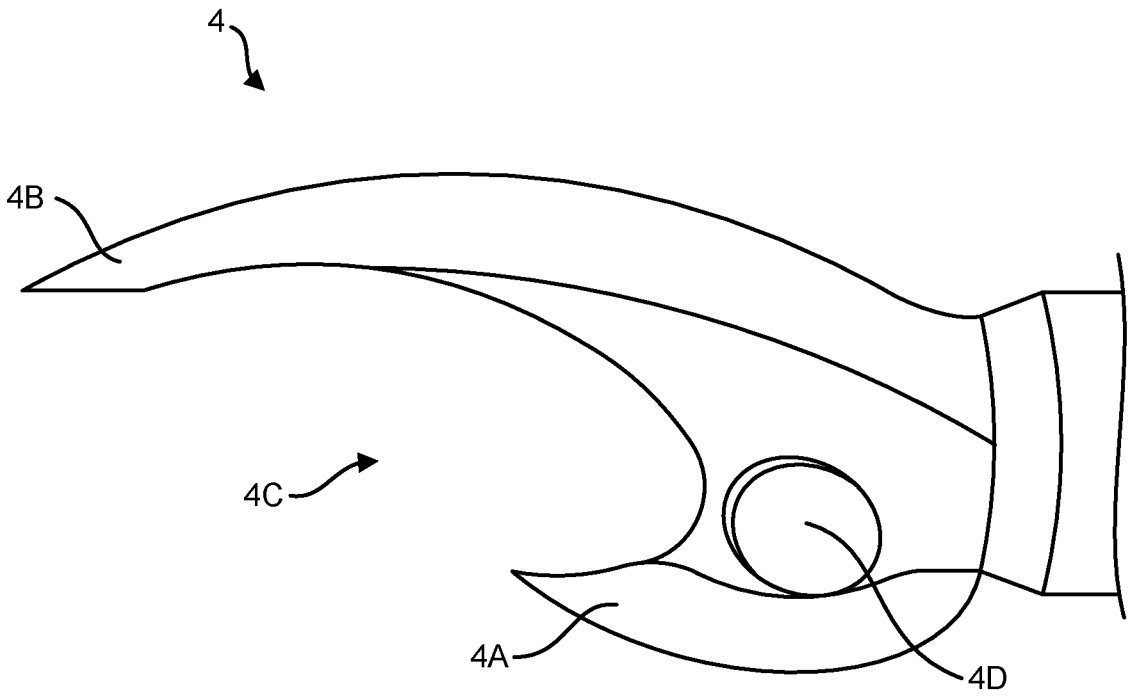
FIG. 5 is a close up view of a sickle blade end of the illustrated rescue bar.

FIGS. 1-9 illustrate various aspects and features of an exemplary embodiment of rescue bar 10 as shown in FIGS. 1-5, including the pairings with a halligan bar 20 to form rescue access tool interlocks 100', 100", 100''' and juxtaposition 100"" depicted in FIGS. 6-9 respectively. Referring to FIGS. 1-3E, rescue bar 10 includes elongate handle 2 with a head end 6 at a first end of handle. In embodiments such as illustrated, head end 6 has a longitudinal central plane that bisects the head end 6. On one side of the plane bisecting head end 6 is a pair of jaw members 6A. On the other side of head end 6 is a blunt hook 6J including strike contact face 6I. A pair of aligned channels 6L disposed on opposed sides of a recessed bridge between the blunt hook 6J and the elongated handle 2, wherein the recessed bridge is disposed along the longitudinal plane of the elongated handle, wherein each of the pair of aligned channels 6L have an inner side wall and an outer side wall stepped up from opposing recessed planar surfaces of the recessed bridge, The recessed planar surfaces of aligned channels 6L merge to the open space and extend to the crown surface. As best illustrated in FIG. 4, various embodiments feature configuring aligned channels 6L such that a lower portion of its opposed inner side walls and outer side walls are disposed in opposed outward directions and an upper portion of its opposed inner side walls and outer side walls are disposed in opposed outward directions.

Referring to FIGS. 1-3E and 4 illustrating the configuration head end 6, blunt hook 6J is disposed on a substantially perpendicular axis of the longitudinal plane of head end 6. As shown, contact strike face 6I forms an outer surface of blunt hook 6J. An inner wall of blunt hook 6J defines open space 6K that extends along a main longitudinal plane aligned with handle 2 to merge with a channel 6L bridging blunt hook 6J and paired jaws 6A. Blunt hook 6J may include a tapered wedge that may be utilized to break apart or otherwise demolish construction materials such as for example, wood, metals, or other materials by striking blows upon the material.

Strike contact face 6I of blunt hook 6J has an outer surface configuring that can be used as striking tool, for example, to strike and thereby amplify force applied to a halligan bar. The force, concomitant with the weight of the rescue bar 10 facilitates expeditious opening of access doors and demolishing construction materials such as, for example, concrete, wood, metals. The amplified force is particularly useful for opening car doors and high security exterior doors and gates, or other materials. Strike contact face 6I may also be struck by a hammer or other striking tool in some applications.

As shown in FIGS. 1-3D and best illustrated in FIG. 4, strike contact face 6I includes a planar surface disposed in parallel alignment with the main longitudinal axis of the handle 2 and perpendicular to the longitudinal central plane of head end 6. As shown in the illustrated embodiment, an upper portion of strike contact face 6I is substantially parallel with the longitudinal of handle 2 while a lower portion of strike contact face 6I is disposed in a slightly offset angle directed inwardly toward handle 2. Now referring to FIGS. 3 and 3A, such offsetting of the lower portion of strike contact face 6I extends inwardly toward handle 2 disposes the lower portion of strike contact face in a continuous longitudinal plane with a portion of the back surface of upper crescent claw 4B on an opposing end of rescue bar 10. Such planar continuity of the lower portion of strike contact face 6I and the back surface of upper crescent claw 4B provides a spaced dual stable contact surface for placing rescue bar 10 on a resting surface. A further feature of blunt hook 6J includes rounding the corners of strike contact face 6I best illustrated in FIGS. 3C, 3E, 4 and 4B. The reduced contact with a surface enabled by the offset lower portion of strike contact face 6I and rounded corners lessens friction and thus eases movement such as sliding on a floor or tabletop to thereby help avoid scratching, abrading or otherwise damaging the surface contacted, especially when dropped or force is otherwise applied to the already heavy load of rescue bar 10. The lack of sharp corners of strike face 6I and overall smooth configuration of blunt end 6J further helps prevent catching and sticking to the materials being demolished thereby easing release of head end 6 following their penetration.

Figure 1:
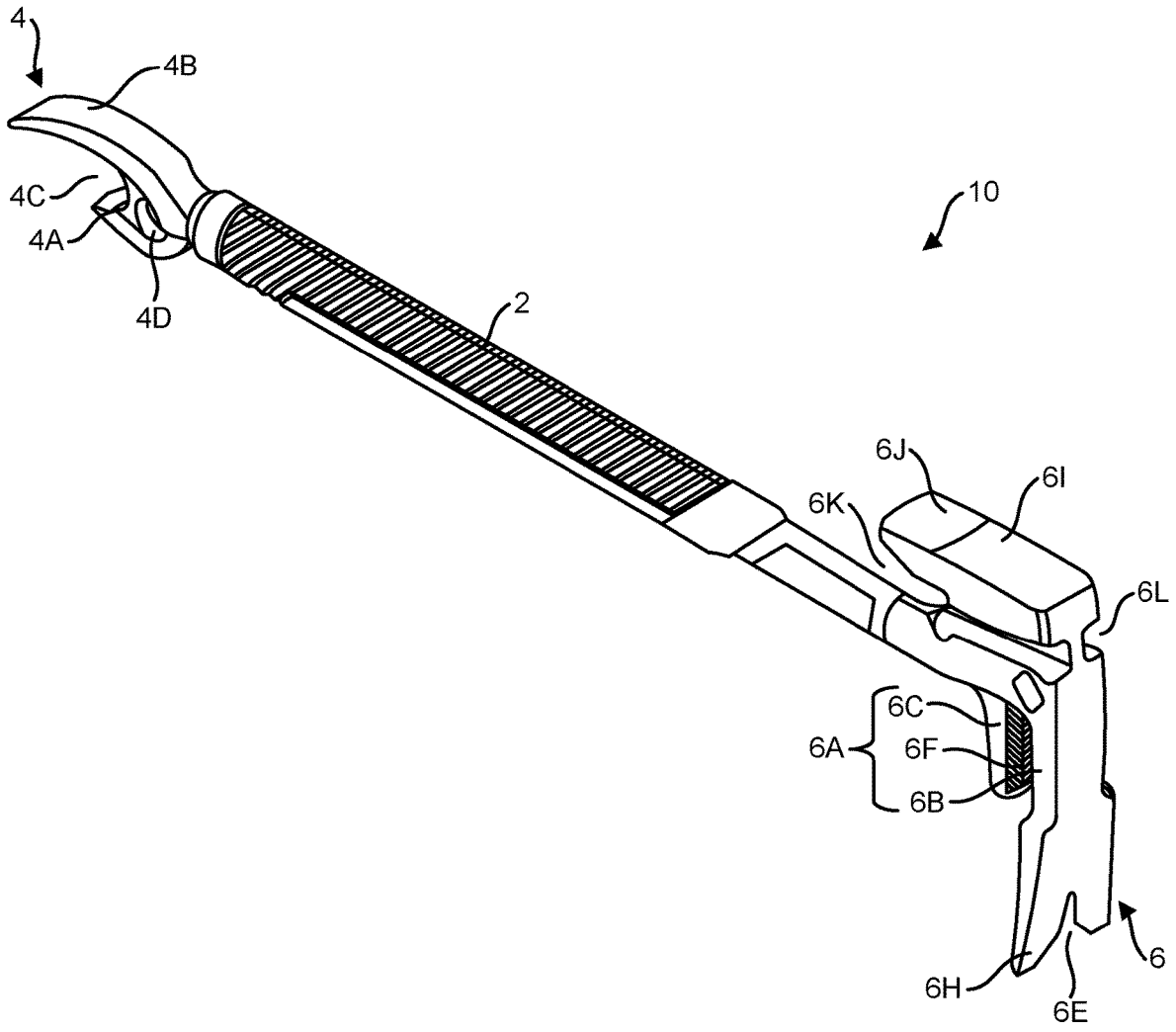
FIG. 1 is a perspective view of the rescue bar of the rescue access tool according to an exemplary embodiment of the invention.

In the illustrated embodiment best shown in FIGS. 1 and 3, head end 6 includes a pair of jaws 6A consisting of upper jaw 6B and lower jaw 6C having opposed inner surfaces configuring gap 6D therebetween. In some embodiments, pair of jaws 6A may be utilized to grasp, manipulate, and/or otherwise demolish building materials such as, for example, lumber, bricks, drywall, concrete blocks and/or tile. Although shown in a fixed position, the upper and/or lower jaws may be adjustable in various alternative embodiments. As shown, an inner surface of lower jaw 6C has recessed teeth 6F. In alternative embodiments, pair of jaws 6A may include more or fewer teeth on upper jaw 6B and/or lower jaw 6C or no teeth at all.

Extended from upper jaw 6B of rescue bar 10 is a chisel end 6H, as illustrated in FIGS. 1-4. Chisel end 6H may be used to penetrate building materials such as wood (or other materials) for the purposes of demolition or for other purposes. In one embodiment, chisel end 6H may be positioned in a joint or gap, for example between a door and corresponding doorjamb, or other surface to be penetrated, and the strike contact face 6I may be struck by a hammer or other striking tool, to thereby drive wedge blade 6A is driven into gap or surface. An extended outer edge of chisel end 6H has a notched lock puller 6E shown best in FIG. 3E. In some embodiments, lock puller 6E may be beveled to facilitate insertion between a lock and door or door jamb. As with other features of rescue bar 10, lock puller 6E may provide further functionalities, including loosening fasteners and other hardware or structural impediments creating a barrier to access a jeopardized space.

Now referring to FIGS. 1-3 and 5, disposed along a coextensive longitudinal axis on an opposing end from head end 6 of the handle 2 is a sickle blade 4 including a lower crescent claw 4A and upper crescent claw 4B integrally extending from a base portion joined to the elongated handle and tapering toward a distal end, wherein a substantially rounded inner periphery coextending from the upper crescent claw and the lower crescent claw configures a clearance space 4C therebetween. A width of upper claw 4B, lower claw 4A and rounded inner clearance space 4C are aligned along a common longitudinal plane with the elongated handle. The tapered distal end of upper crescent claw 4B extends beyond the tapered distal end of upper crescent claw 4A. Extending from inner clearance space 4C toward handle 2 and disposed in the base portion is a recessed portion having perpendicularly disposed side walls stepped up to opposed raised surfaces of lower claw 4A and upper crescent claw 4B joining opposed open ends of the recessed portion. Hence, the recessed portion disposed between opposed stepped side walls between lower claw 4A and the upper crescent claw 4B merges into the clearance space 4C.

In one embodiment, rescue bar 10 includes an aperture 4D. Aperture 4D hole extends completely through the width of sickle blade end 4. FIGS. 1-3 and 5 illustrate rescue access tool 10 having aperture 4D according to an embodiment. In some embodiments aperture 4D or other openings may be located in another element. A through hole such as aperture 4D may be drilled, punched or molded in various dimensions and configurations for multifarious uses, as detailed above. A particular efficacious utility of aperture 4D is for receiving a paired carabiner or other clasp or loop mechanism so as to attach a line or rope composed of a durable and strong textile such as nylon, metal wire rope or other suitable material.

An additional advantageous functionality of rescue bar 10 is provided by secure anchoring of blunt hook 6, or paired jaws 6B, 6C in or about material of a structure, for example by wedging against a gap, bar or plank, and then releasing and rappelling along the line attached to aperture 4D to safety. An escape route from an elevated level, for example through a window or from a rooftop or upper deck, may thus be accessed when other exits are blocked or unsafe. Alternatively, a rescue worker could also lower a person or pet affixed to the line to a lower level.

In preferred embodiments such as illustrated in FIGS. 1-9 and best shown in FIG. 2, rescue bar 10 is forged from a single piece of steel. Together with the durable, hardy and dense composition of the steel and lack of joints or welds, rescue bar 10 wields superior force to expedite rescue operations requiring latch disengagement and/or demolition for access. To ameliorate concomitant weight of such a heavy-duty construction, handle 2 may include one or more cavities 2A best shown in FIG. 1A. Additional cavities may be disposed along handle 2 to further reduce the mass and weight of rescue bar 2. Thus lightening the load typically increases speed and endurance and thereby enhances the performance of a fire fighter or other rescue worker.

In alternative embodiments the sides of handle 10 of rescue bar 10, as well as second handle 12 of halligan bar 20, may include one or more cavities. For example, they could include just one long cavity or multiple smaller cavities per side. In some embodiments, each may have differing numbers and patterns of recesses.

In various embodiments best illustrated in FIG. 2, rescue access tool 10 includes a grip cover 2C that may be attached to handle 2 by tightening screws 2C into corresponding threaded apertures disposed in steel handle bar 2B. Grip cover 2C may be composed of any skid resistant, and preferably resilient, material such as, for example, rubber, plastic, or other material on handle 2 and second handle 12 or other portions of rescue bar 10. The gripping material may be placed over or affixed to rescue access tool 10 to provide a more secure and comfortable grip for the rescue worker's hands. In some embodiments such as illustrated in FIGS. 1-9, protruding portions configured for seating within corresponding cavities may be included on an inner surface of the grip material. In addition to enhanced gripping, seated engagement of the protruding portions of the interior of grip cover 2C and corresponding cavities of steel handle bar 2B provide an esthetic and smooth surface for handle 2.

In the illustrated embodiments, rescue access tool 100', 100", 100''' includes halligan bar 20 with adze pick end 14 and fork lever 16 disposed on opposed ends of second handle 12. As shown in FIGS. 6-9, halligan bar 20 includes handle 12 with a fork lever 16 and an adze pick end 14 disposed along a substantially longitudinal axis. Now referring to FIGS. 6, 7 and 8, fork lever 16 has a slot between tapered prongs that may be manipulated to remove fasteners such as, for example, nails, brads, staples, to enable demolishing or prying apart of materials. On an opposing end to fork lever 16 is an adze pick end 14 including adze 14A and pick 14B. In the illustrated embodiment, adze 14A is bent in a direction that is offset from a perpendicular axis of handle 12 toward fork lever end 16 to facilitate prying and striking force. Pick 14B is circumferentially tapered and terminates in a pinnacle end to facilitate insertion within small joints or holes such as, for example, of door locks to thereby penetrate multi-stepped and deeply creviced spaces in keyholes and latches to thereby breach an engaged lock.

Figure 6:
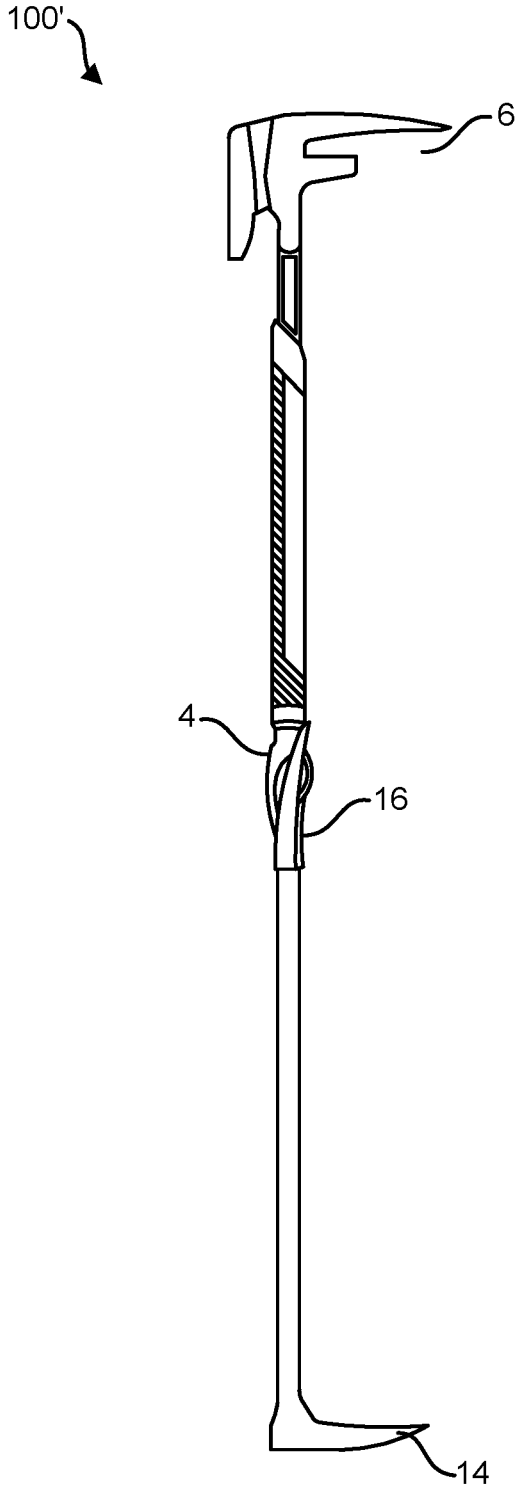
FIG. 6 illustrates an exemplary first interlock of the sickle blade end of the rescue bar and the bent fork lever end of the halligan bar in a clasped interlock.
Figure 7:
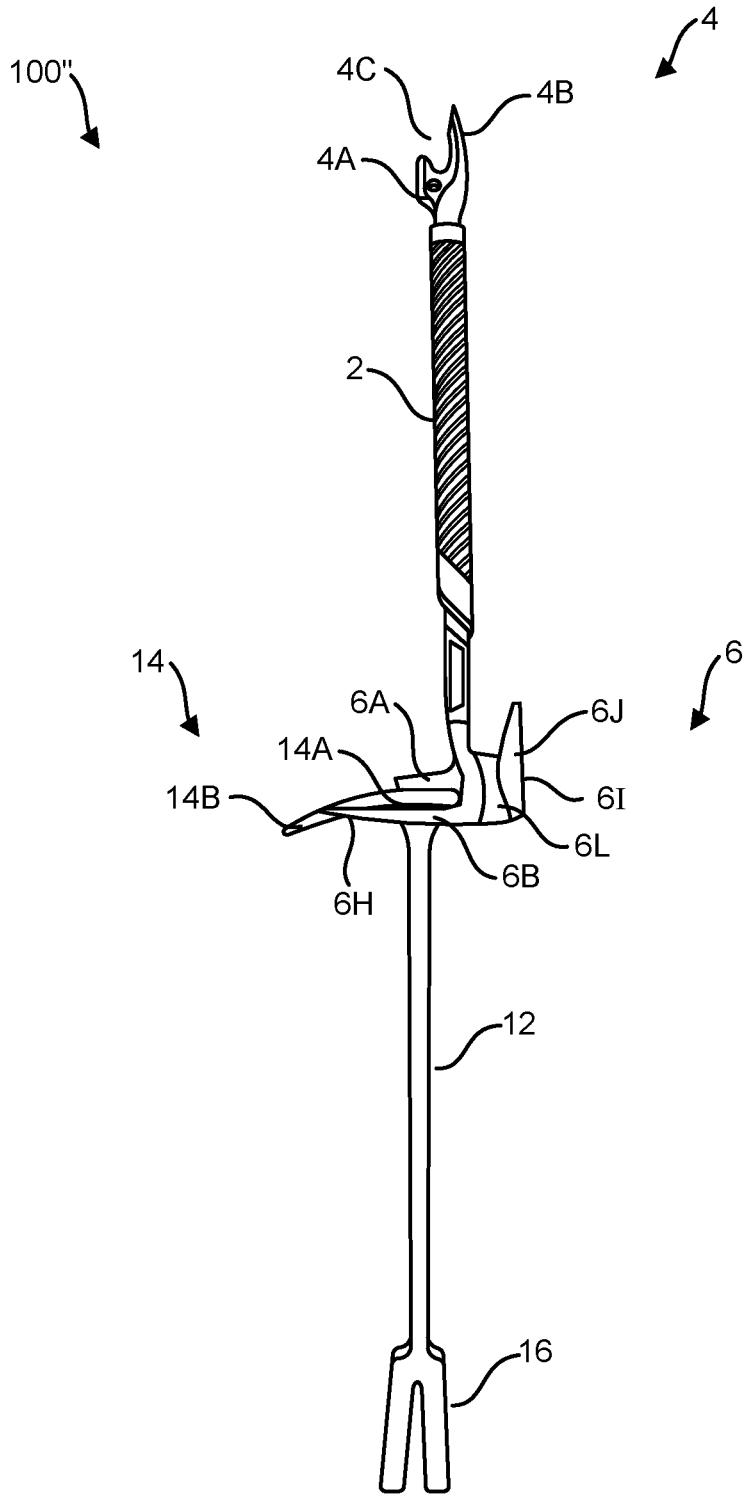
FIG. 7 illustrates a view of exemplary second interlock of the head end of the rescue bar and the adze pick end of the halligan bar in a stepped interlock.

FIGS. 6 and 7 illustrating the clasped interlock 100' and a stepped interlock 100" of the present invention show an aspect of adze 14A having a tapered blade bent inwardly from a perpendicular axis of handle 12. In the clasped interlock 100', adze 14A may thus be used to pry material or remove a fastener on a flat work surface without head end 6 causing rescue bar 10 to prematurely bottom out.

In one embodiment best shown in FIG. 2, rescue bar 10 is a single integrally forged or molded metal material, as opposed to being formed from multiple parts jointed or fastened together. Although preferred embodiments of the present rescue bar, as well as halligan bar, are preferably forged from a single piece of steel, alternative compositions may employ other suitable materials that are harder than the materials they will be used to demolish such as, for example, wood, aluminum, or other materials. The materials may in some embodiments include components that are welded or otherwise fastened.

Figure 3A:
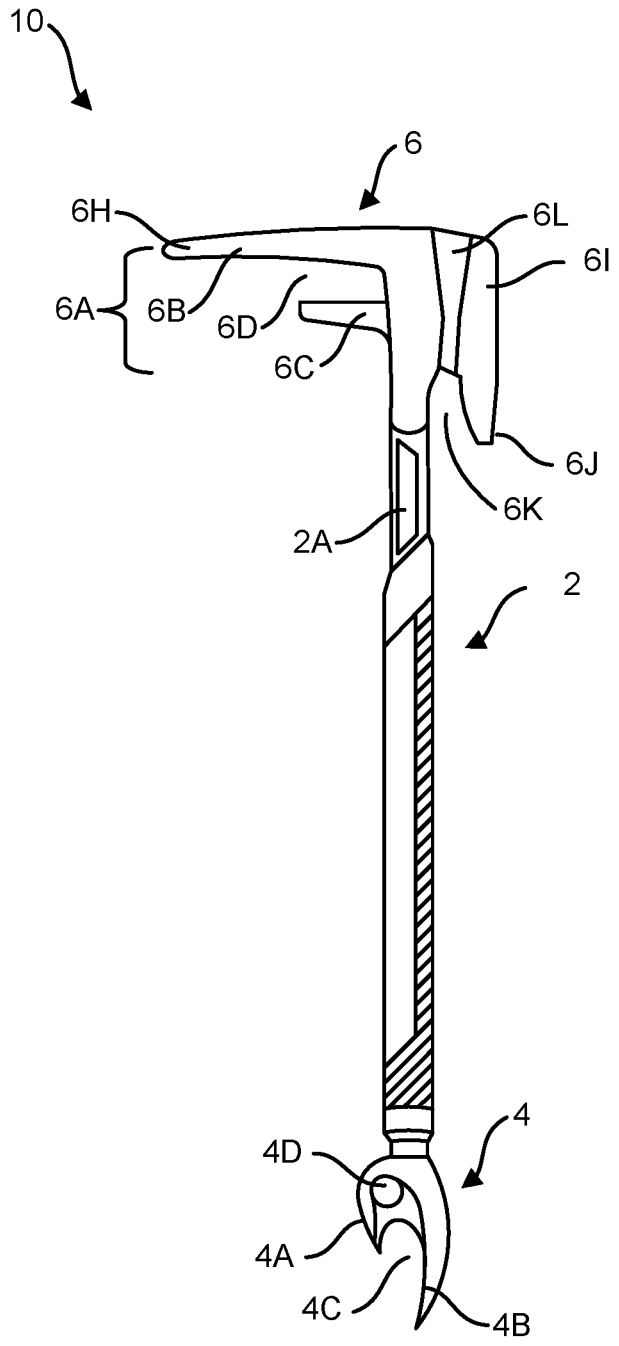
FIG. 3A is a right side view of the illustrated rescue bar.
Figure 3B:
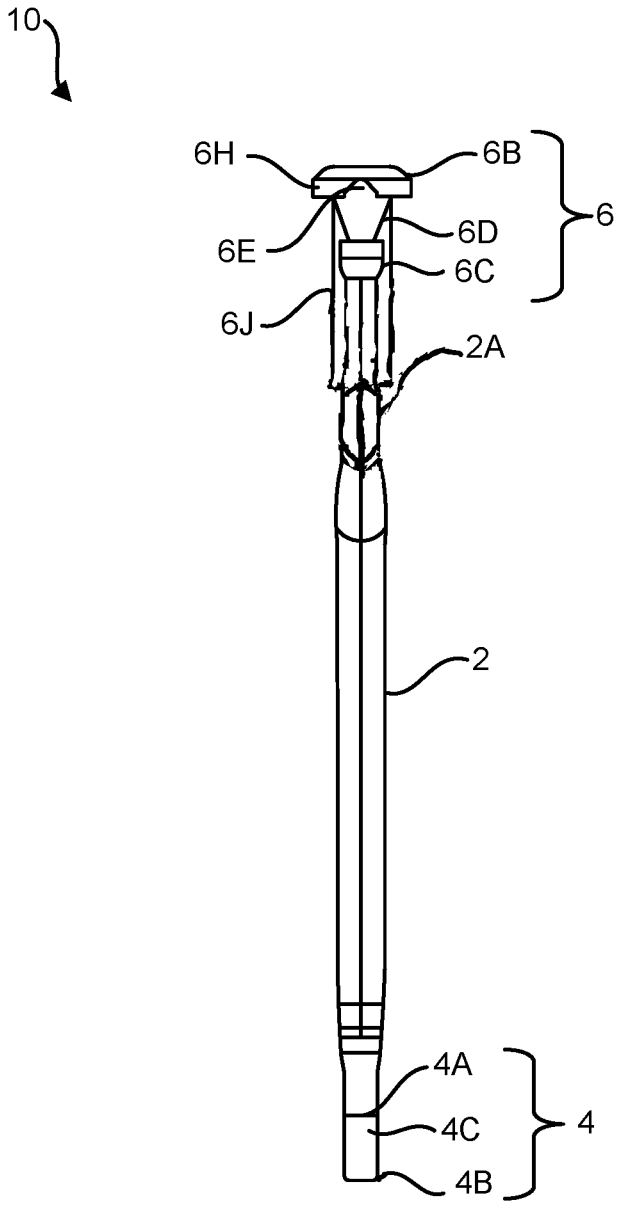
FIG. 3B is a front view of the illustrated rescue bar.
Figure 3C:
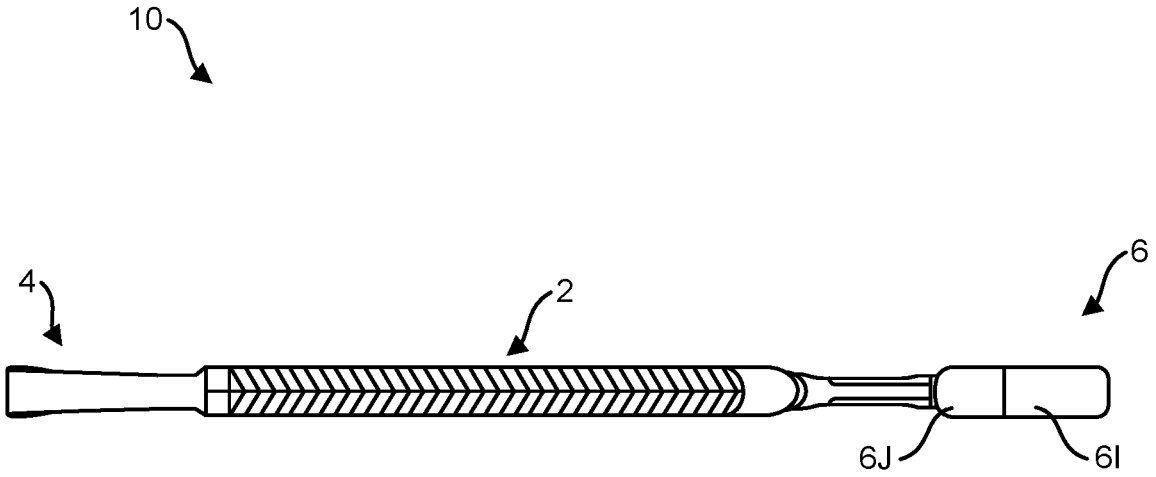
FIG. 3C is a rear view of the rescue bar.
Figure 3D:
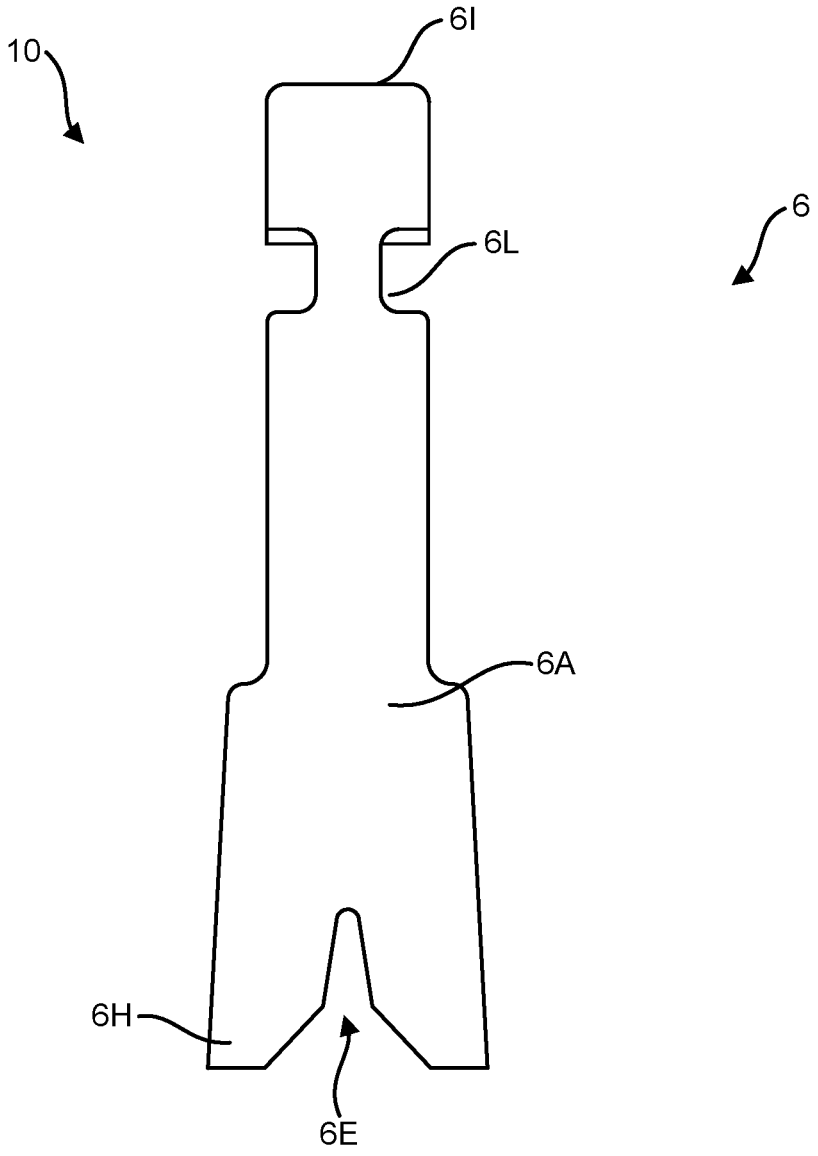
FIG. 3D is a top view of the illustrated rescue bar.

Now referring to FIGS. 3A and 3B and best shown in FIG. 4, rescue bar 10 includes an upper portion of open space 6K configured with an angled notch and adjacent planar surface adapted for coupling with and thereby enabling manipulation of hexagon headed fasteners such as, for example, used for fire hydrant and hose fittings and connectors, and may be adaptable to other fasteners and/or suitably configured hardware or objects.

As mentioned above, rescue bar 10 may be utilized to pry open, break apart or otherwise demolish enable forcible entry by placing chisel end 6H in a gap, such as, for example, between a door and a corresponding doorjamb, or on a surface and strike contact face 6I is struck by a hammer or other tool, thus, driving chisel end 6H. The elongated positioning of chisel end 6H beyond lower jaw 6C enables deep penetration of the strike area.

In some embodiments, open space 6K may be used to manipulate pentagonal nuts on fire hydrants, or loosen, tighten, or otherwise manipulate nuts or other fasteners having standard configurations. In some of such other embodiments, pair of jaws 6A can have two or more stepped, angled or otherwise configured surfaces that correspond or mate with surfaces of the fastener. For example, pair of jaws 6A and/or open space 6K may be configured for adaptive engaging to a corresponding depth and length, slope or taper or composition of target material surfaces.

Rescue bar 10 and halligan bar 20 may be provided in a number of lengths, typically ranging between 18-54 inches, but can also be shorter or longer. They may be composed of an integrally molded metal material, or include multiple parts jointed or fastened together. The rescue access tool, including the handle, the head end, the bent end pry bar, and/or other portions of the rescue access tool, may comprise a single integrally molded metal material. Rescue bar 10 and halligan bar 20 are manufactured to weigh between 6 to 12 pounds.

To provide further advantages of increased speed and force for expediting entry to rescue victims and mitigate damage during emergencies, rescue bar 10 is configured for mated engagement with corresponding ends of respective fork lever 16 and pick adze 14 ends of halligan bar 20.

As shown in FIGS. 6-9, respective opposing ends of rescue bar 10 and halligan bar 20 can be coupled to provide at least three extended interlocks 100', 100", 100'''. FIG. 10 shows rescue access tool 100'''' paired in parallel juxtaposition when not in use.

In a clasped interlock 100' shown in FIGS. 6 and 6A, sickle blade 4 is inserted through the space between the two prongs of fork lever 16. The prongs are seated on respective recesses extending from space 4C such that the inner edges of fork lever 16 prongs are in abutted engagement with corresponding surfaces of the side walls such that fork lever 16 is wedged in mated engagement against respective raised surface of lower claw 4A and extended upper claw 4B and the intermediary portion edge 4D of sickle blade 4. When used in clasped interlock 100', the extended length and commensurate force imparted to head end 6 and adze 14 enable a commensurate increase in the force imparted to the materials, reducing the amount of strikes and time for forcible entry.

Figure 7A:
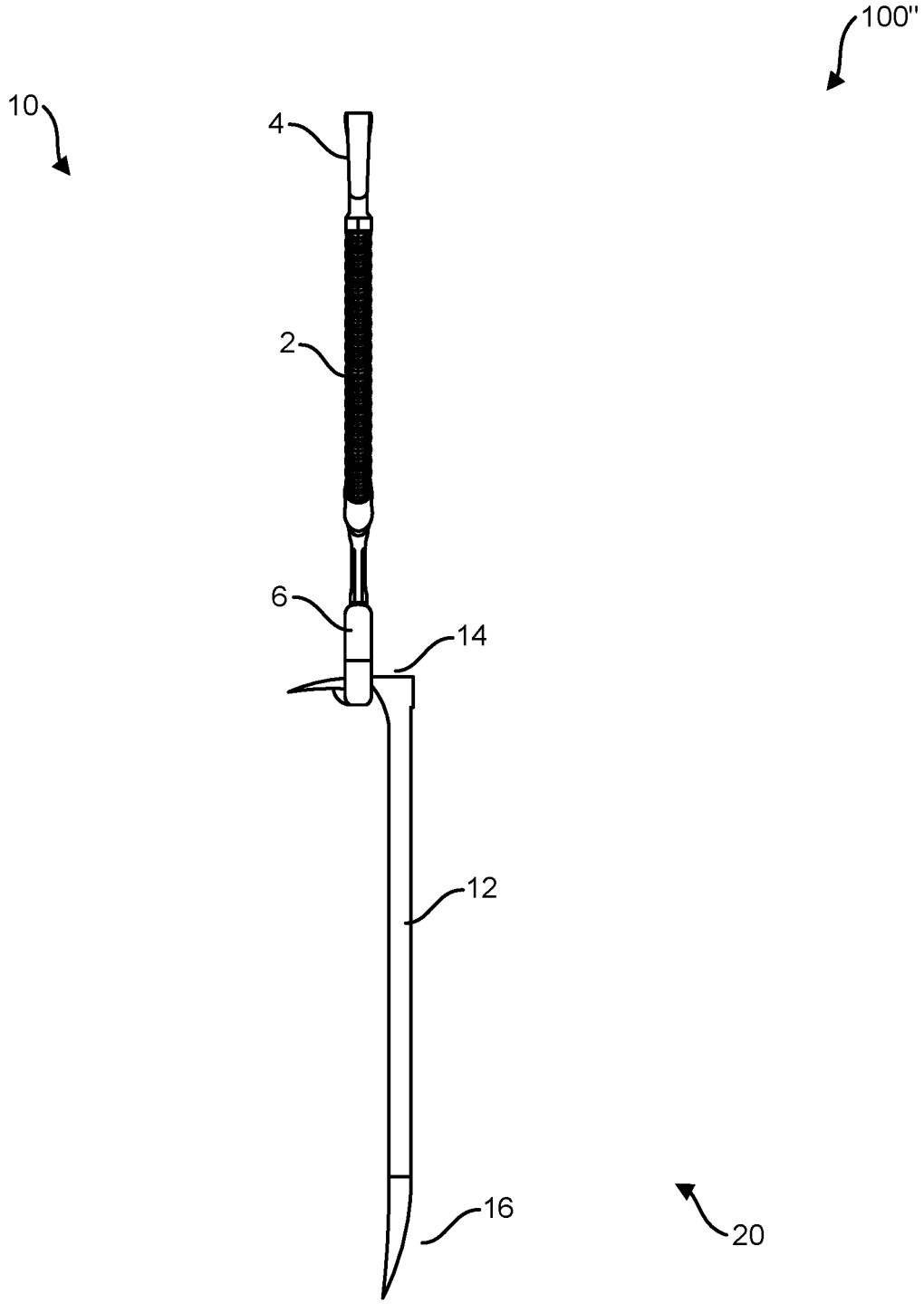
FIG. 7A illustrates another view of the exemplary second interlock of FIG. 7.

In stepped interlock 100" illustrated in FIGS. 7 and 7A, rescue bar 10 and halligan bar 20 are coupled by seated engagement of pick adze 14 within gap 6D between upper jaw 6B and lower jaw 6C of paired jaws 6A in head end 6. Pick adze 14 is further secured by seating pick 14B in notch 6E of wedge end 6H when rescue bar 10 and halligan bar 20 are paired in an extended stepped interlock. In addition to imparting additional force and power for use of fork lever 16 and sickle blade 4, simultaneously positioning claw 4 on a lower level and an outer edge of fork lever end 16 at an elevated level positions the crown surface of head end 6 so as to provide a step up to the elevated level.

Figure 8:
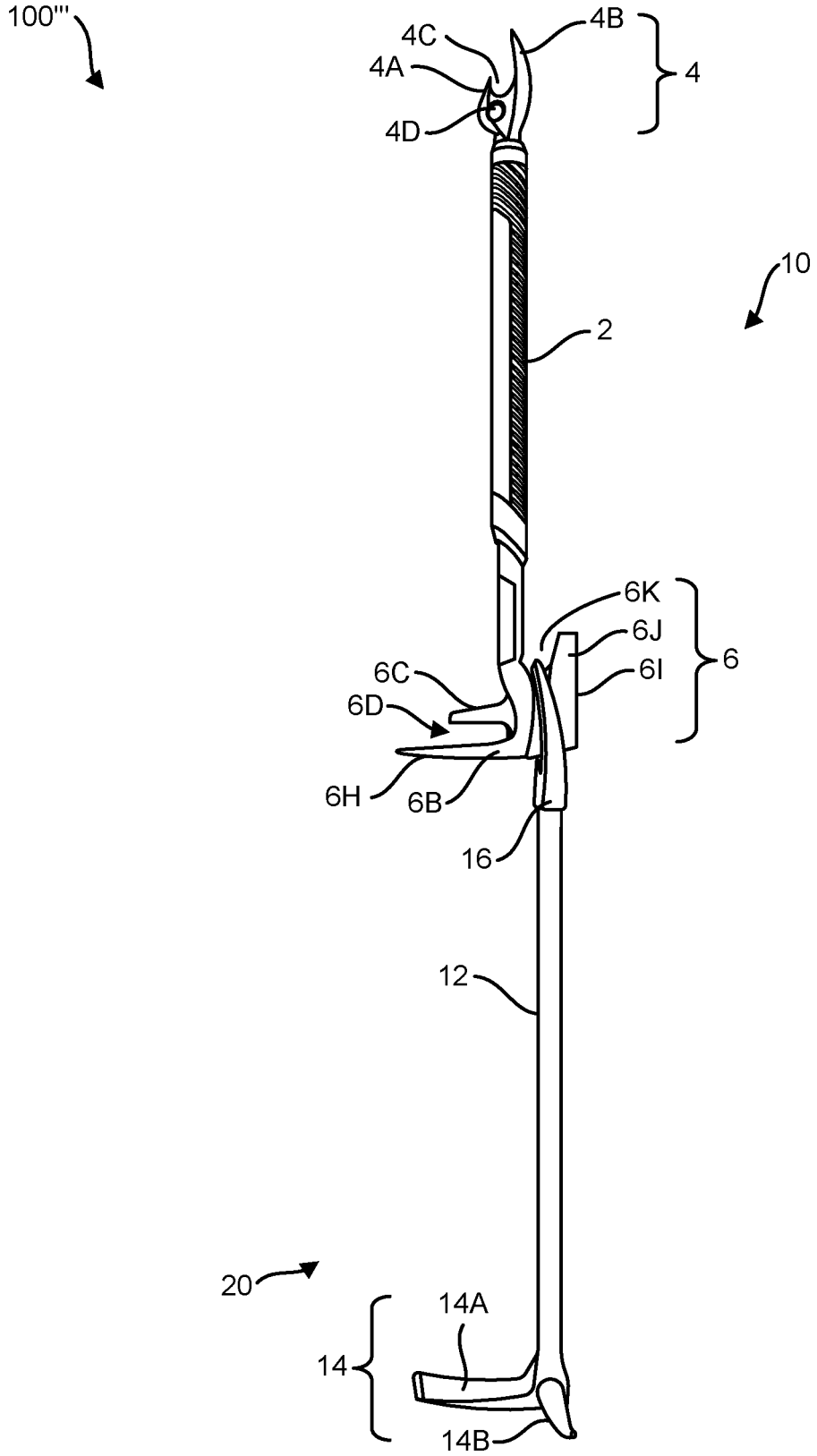
FIG. 8 illustrates an interlock of the head end of the rescue bar and the bent fork lever end of the halligan bar of the rescue access tool in an extended interlock.
Figure 9:
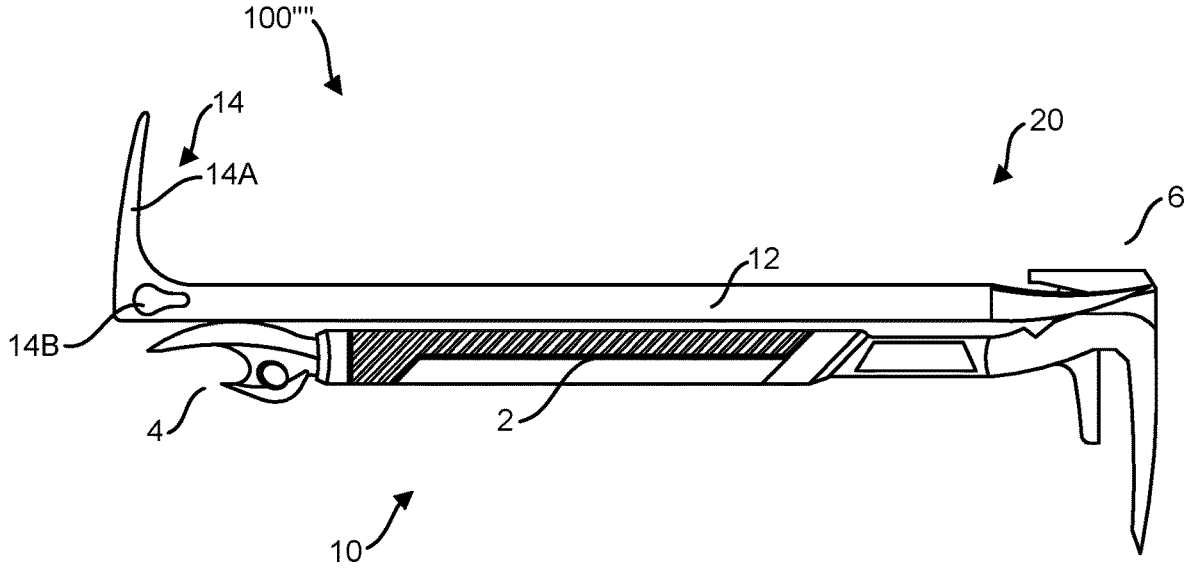
FIG. 9 illustrates a parallel juxtaposition of the rescue bar and the halligan bar of the rescue access tool.

In another functionality provided by pairing of rescue bar 10 and halligan bar 20 to form interlock 100''' illustrated in FIGS. 8 and 8A, the pair of aligned channels 6L of head end 6 of rescue bar 10 are configured for coupled engagement with a pair of aligned prongs of a fork lever end of a halligan bar wherein the rescue bar and the halligan bar are in extended paired interlock 100''' and in a side-by-side parallel juxtaposition 100'''' securely coupling halligan bar fork lever end 16 in abutted engagement between the aligned channels 6L of head end 6 of rescue bar 10 for facilitating storage and transport of the rescue access tool. In parallel juxtaposition 100'''', strike contact face 6I is faced outwardly thereby enabling setting the lower portion of strike contact face 6I and the back surface of upper crescent claw 4B in a stable position on a resting surface.

In addition to the compounded force imparted by the leverage of the rescue access tool provided by interlocks 100', 100", 100''', the elevation imparted by the added length of handles 2 and 12. Thus raising the total handle length closer to shoulder height reduces the need to bend down and thereby lessens stress and possible injury to the back.

In some embodiments, recessed portions along the handle 2 and second handle 12 may further include a layer of slip resistant and/or padded grip material. Such grip materials may include, for example, one or more types of plastic or rubber that provide increased grip and/or comfort for a user of a rescue access tool. In some embodiments, layers may be from a material (e.g., plastic, rubber, or other material) that provides impact or shock cushioning for protecting a user's hands.

Rescue bar 10 and halligan bar 20 may be provided in a number of lengths, typically ranging between 18-54 inches. They may be composed of an integrally molded metal material, or include multiple parts jointed or fastened together. The rescue access tool, including the handle, the head, the bent end pry bar, and/or other portions of the rescue access tool, may comprise a single integrally molded metal material. In many embodiments, rescue bar 10 and halligan bar 20 is manufactured to weigh between 6 to 12 pounds and of a composition harder than the materials it is used to strike (e.g., wood, aluminum, or other materials).

While the invention has been described with reference to the certain illustrated embodiments, the words that have been used herein are words of description, rather than words of limitation. Changes may be made, within the purview of the associated claims, without departing from the scope and spirit of the invention in its aspects. Although the invention has been described herein with reference to particular structures, acts, and materials, the invention is not to be limited to the particulars disclosed, but rather can be embodied in a wide variety of forms, some of which may be quite different from those of the disclosed embodiments, and extends to all equivalent structures, acts, and materials, such as are within the scope of the associated claims. For example, additional features such as, for example, other wrench open of aperture elements, a spanner wrench element, a hook or pin element, and/or other features may provide substantially the same structure, function and purpose of the present invention. Other features may include a heat resistant material to protect against transfer of heat from flaming or hot surfaces or a light reflective or phosphorescent material for visualization in in low light or no light situations.

In some embodiments, inserts may be made from a material that provides any one or more of comfort grip, shock absorption, differential indication, heat transfer resistance, electrical shock insulation, luminescence, light reflection, and/or other features.

Accordingly, the scope of the present invention is not delimited by the literal language of this specification and the appended claims. Rather, modifications, permutations, additions and sub-combinations are embraced by the spirit and scope of the invention. Hence, such and other variations are included in the scope of the invention, describe, illustrated and claimed herein.

The invention claimed is:

1. A multi-use rescue bar, comprising:

an elongated handle;

a head end at one end of the handle, the head end including a first side and a second side opposite the first side and a crown surface, the first side of the head end including a strike contact surface, wherein at least an upper portion if the strike contact face is disposed in substantially parallel alignment with a longitudinal axis of the elongated handle, the second side having a pair of jaws including an upper jaw and a lower jaw protruding outwardly from the longitudinal axis of the elongated handle, wherein a continuous inner edge of the upper jaw and the lower jaw merge to form a mouth portion proximate to the elongated handle so as to configure a gap between the upper jaw and the lower jaw and the first side including a blunt hook, wherein the strike contact surface forms an outer wall of the blunt hook, and wherein the blunt hook has an inner wall taper toward a distal end and is spaced apart from a corresponding portion of the first side and the elongated handle to thereby configure an open space therebetween;

a pair of aligned channels disposed on opposed sides of the head end configuring a recessed bridge between the blunt hook and the first side, wherein the recessed bridge is disposed along a longitudinal axis in substantially parallel alignment with the elongated handle, wherein each of the pair of aligned channels have an inner side wall and an outer side wall angled upwardly from opposing recessed bottom surfaces disposed along the longitudinal axis so as to merge into the open space, and wherein the pair of aligned channels and open space are configured to receive a corresponding portion of a tool or object;

a sickle blade end disposed on an opposing end of the elongated handle from the head end, wherein the sickle blade end has an upper crescent claw and a lower crescent claw, wherein the upper crescent claw and the lower crescent claw have opposed outward facing peripheries and opposed inward facing peripheries integrally extending from a base portion joined to the sickle blade end of the elongated handle, wherein the opposed outward facing peripheries and opposed inward facing inner peripheries of the upper crescent claw and lower crescent claw are substantially rounded and taper toward inwardly facing ends, and wherein the opposed inward facing peripheries coextending from the upper crescent claw and the lower crescent claw configure a clearance space therebetween, and wherein the sickle blade end includes a base portion having a recessed portion disposed between the lower crescent claw and the upper crescent claw such that the recessed portion merges into an adjacent portion of the clearance space, and wherein one of either the upper crescent claw or the lower crescent claw is longer than the other of the upper crescent claw or the lower crescent claw.

2. The multi-use rescue bar of claim 1, wherein a lower portion of the inner side walls and a lower portion of the outer side walls are disposed in opposed outward directions and an upper portion of the inner side walls are disposed in opposed outward directions.

3. The multi-use rescue bar of claim 1, further comprising an aperture disposed in the base portion of the sickle blade end.

4. The multi-use rescue bar of claim 3, wherein the elongated handle, head end and sickle blade end are forged from a single piece of steel.

5. The multi-use rescue bar of claim 4, wherein a gap formed between the spaced paired jaws extends in a generally perpendicular direction from the handle.

6. The multi-use rescue bar of claim 5, wherein a portion of the strike contact surface proximal to the distal end of the blunt hook is offset at a slight angle from the portion of the strike contact surface in substantially parallel alignment with a longitudinal axis of the elongated handle such that the portion of the strike contact face proximal to the distal end of the blunt hook is in substantially planar longitudinal alignment with an outer portion of the rear surface of the sickle blade end such that the portion of the strike contact surface in substantially parallel alignment with a longitudinal axis of the elongated handle avoids direct contact with a platform surface when the strike contact surface proximal to the distal end of the blunt hook and the rear surface of the sickle blade end are simultaneously placed onto the platform surface.

7. The multi-rescue tool of claim 6, wherein the strike contact surface includes opposed side edges disposed between opposed top and bottom edges adjoined by rounded corners.

8. The multi-use rescue bar of claim 7, further comprising a chisel end extended from the upper jaw of the paired jaws.

9. The multi-use rescue bar of claim 8, wherein a distal edge of the chisel end incorporates a notch.

10. The multi-use rescue bar of claim 9, wherein the notch includes a beveled edge.

11. The multi-use rescue bar of claim 10, wherein an upper portion of the elongated handle adjacent to the recessed bridge and facing the blunt hook includes a concavity having an adjoined angled surface disposed on an upper edge of the open space configured for use as an adaptive wrench.

12. The multi-use rescue bar of claim 11, wherein the recessed portion disposed between the lower claw and the upper crescent claw are configured for coupled engagement with a slot between a pair of aligned prongs of a fork lever end of a halligan bar such that the rescue bar and the halligan bar are extended in a clasped interlock.

13. The multi-use rescue bar of claim 12, wherein the pair of jaws of the head end and the notch of the chisel end of the upper jaw are configured for coupled engagement when the adze pick end of a halligan bar is seated such that an adze is secured between the pair of jaws and the pick is seated on the notch of the chisel end when the adze pick end is paired with the pair of jaws in an are paired in an extended stepped interlock of the rescue bar and the halligan bar; seating the pick when the adze pick end is paired with the pair of jaws in an extended stepped interlock of the rescue bar and halligan bar.

14. The multi-use rescue bar of claim 13, wherein the pair of aligned channels of the head end of the rescue bar are configured for coupled engagement with a pair of aligned prongs of a fork lever end of a halligan bar such that coupled engagement of the aligned channels with the aligned prongs are capable of securing the rescue bar and the halligan bar in a paired extended interlock and in a side-by-side parallel juxtaposition.

15. A multi-use rescue bar, comprising:

an elongated handle having one or more elongated cavities formed therein;

a head end at one end of the handle, the head end includes a first side and a second side on opposing sides of a longitudinal axis of the elongated handle, wherein the first side has a pair of jaws including a lower jaw and an upper jaw that extends beyond the lower jaw and wherein the lower jaw and the upper jaw have corresponding opposed inner edges configuring a gap generally opposite the second side, wherein the second side includes a blunt hook having an outer strike contact surface, wherein at least a portion of the outer strike contact face is disposed in substantially parallel alignment with the longitudinal axis of the elongated handle and the blunt hook includes an opposing inner wall, wherein the inner wall of the blunt hook tapers toward a distal end and is spaced apart from a corresponding portion of the first side and the elongated handle to thereby configure an open space therebetween;

a chisel end disposed on a distal end of the upper jaw;

a pair of aligned channels disposed on opposed planar surfaces of the head end configuring a recessed bridge between the blunt hook and the first side, wherein the recessed bridge is disposed along a longitudinal axis in substantially parallel alignment with the elongated handle, wherein each of the pair of aligned channels has an outer side wall and an inner side wall angled upwardly from opposing recessed bottom surfaces disposed along the common substantially longitudinal axis so as to merge into the open space and wherein the pair of aligned channels and open space are configured to receive a corresponding portion of a tool or object; and a sickle blade end disposed on an opposing end from the head end, wherein the sickle blade end is disposed along a common longitudinal plane with the elongated handle, wherein the sickle blade end includes an upper crescent claw and a lower crescent claw, wherein a substantially rounded inner periphery coextending from the lower crescent claw and the upper crescent claw configures an inner clearance space, and wherein the upper crescent claw is longer than the lower crescent claw.

16. The multi-use rescue bar of claim 15, wherein a portion of the strike contact surface proximal to the distal end of the blunt hook is offset at a slight angle from the portion of the strike contact surface in substantially parallel alignment with the longitudinal axis of the elongated handle, and wherein the lower portion of the strike contact is in substantially planar longitudinal alignment with an outer portion of the rear surface of the sickle blade end such that the portion of the strike contact surface is in substantially parallel alignment with a longitudinal axis of the elongated handle avoids direct contact with a platform surface when the strike contact surface proximal to the distal end of the blunt hook and the rear surface of the sickle blade end are simultaneously placed onto the platform surface.

17. The multi-use rescue bar of claim 16, wherein the open space includes a concavity having an adjoined angled surface disposed on an upper edge of the open space configured for use as a wrench.

18. The multi-use rescue bar of claim 15, wherein an aperture is disposed through the base portion of the sickle blade end.

19. The multi-use rescue bar of claim 18, wherein the pair of jaws of the head end are configured for coupled engagement with an adze pick end of a halligan bar so the adze pick end is capable of being secured in the gap between the pair of jaws and further comprising a notch disposed on the chisel end of the upper jaw, wherein the notch is configured for seating the pick when the adze pick end is paired with the pair of jaws in an extended stepped interlock of the rescue bar and halligan bar.

20. The multi-use rescue bar of claim 19, wherein the pair of aligned channels between the first side and the second side of the head end of the rescue bar are configured for coupled engagement with a pair of aligned prongs of a fork lever end of a halligan bar such that coupled engagement of the aligned channels with the aligned prongs are capable of securing the rescue bar and the halligan bar in an extended paired interlock and in a side-by-side parallel juxtaposition.

* * * * *